US006696657B2

(12) United States Patent
Hirose et al.

(10) Patent No.: US 6,696,657 B2
(45) Date of Patent: Feb. 24, 2004

(54) PUFFER TYPE GAS CIRCUIT BREAKER

(75) Inventors: Makoto Hirose, Hitachi (JP); Hideo Kawamoto, Hitachi (JP); Tetsu Ishiguro, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/295,875

(22) Filed: Nov. 18, 2002

(65) Prior Publication Data

US 2003/0094437 A1 May 22, 2003

Related U.S. Application Data

(63) Continuation-in-part of application No. 10/091,532, filed on Mar. 7, 2002, now abandoned.

(30) Foreign Application Priority Data

Nov. 21, 2001 (JP) ..... 2001-356496

(51) Int. Cl.[7] ..... H01H 33/88
(52) U.S. Cl. ..... 218/63; 218/64; 218/54
(58) Field of Search ..... 218/53, 54, 62, 218/63, 64, 72, 73, 77, 43

(56) References Cited

U.S. PATENT DOCUMENTS 4,418,256 A * 11/1983 Graf ..... 218/53
4,562,322 A * 12/1985 Yamaguchi et al. ..... 218/85
4,791,256 A * 12/1988 Yonezawa et al. ..... 218/53
5,231,256 A * 7/1993 Yamagiwa et al. ..... 218/63
5,274,205 A * 12/1993 Tsukushi et al. ..... 218/63
5,850,065 A * 12/1998 Yaginuma et al. ..... 218/76

FOREIGN PATENT DOCUMENTS

| | | |
|---|---|---|
| JP | 48-38216 | 11/1973 |
| JP | 49-17654 | 5/1974 |
| JP | 5-74287 | 3/1993 |
| JP | 5-94743 | 4/1993 |
| JP | 7-296689 | 11/1995 |

* cited by examiner

*Primary Examiner*—Lincoln Donovan
*Assistant Examiner*—M. Fishman
(74) *Attorney, Agent, or Firm*—Mattingly, Stanger & Malur, P.C.

(57) ABSTRACT

A puffer type gas circuit breaker wherein an insulated nozzle made of heat proof resin and a movable arc contact are mounted on a puffer cylinder to perform an open/close operation of the contact. The insulated nozzle is divided into three areas of a downstream area, an area in the vicinity of the throat and an upstream area. The downstream area and the upstream area are made of heat proof resin alone, while the area in the vicinity of the throat is formed of heat proof resin mixed with an inorganic material such as boron nitride. A movable arc contact cover made of heat proof resin having a downstream area and an upstream area is provided between the insulated nozzle and the movable arc contact, and only the downstream area of the contact cover is made of heat proof resin mixed with inorganic material.

5 Claims, 3 Drawing Sheets

PUFFER TYPE GAS CIRCUIT BREAKER

This is a continuation-in-part (CIP) application of U.S. Ser. No. 10/091,532 filed Mar. 7, 2002, now abandoned, the entire disclosure of which is hereby incorporated by reference.

BACKGROUND OF THE INVENTION

The present invention relates generally to a circuit breaker. More particularly, the invention relates to a puffer type gas circuit breaker having an insulated nozzle formed of heat proof resin and guiding arc extinguishing gas, and thus being suitable as circuit breaker for electric power.

A puffer type gas circuit breaker commonly uses arc suppression sulfur hexafluoride ($SF_6$) gas, which is compressed and is blown between contacts in the process of opening from a closed state, whereby arc occurring between contacts is extinguished to ensure that a large current can be interrupted.

A common configuration of the aforementioned puffer type gas circuit breaker will be described with reference to FIGS. 4 and 5:

FIG. 4 shows that the circuit breaker is closed, while FIG. 5 depicts that the circuit breaker is in the process of opening.

In the closed state illustrated in FIG. 4, a fixed arc contact 1 is in touch with a movable arc contact 3 and is engaged with each other, hence a current path is formed between fixed arc contact 1 and movable arc contact 3.

The movable arc contact 3 together with an arc suppression gas feed insulated nozzle 2 is mounted on the puffer cylinder 4 and is locked therein. An insulated operation rod 6 is connected to this puffer cylinder 4. Accordingly, the insulated operation rod 6 is moved in a predetermined direction (lateral direction in this Figure) by an operation mechanism (not illustrated), whereby the insulated nozzle 2 and movable arc contact 3 are also fed in the lateral direction together with the puffer cylinder 4. Thus, closing operation and breaking operation are performed.

In this case, a puffer piston 5 is fitted in the puffer cylinder 4 and is locked at a fixing section (not illustrated), whereby a puffer chamber 7 for compressing arc suppression gas is formed in the puffer cylinder 4.

The parts constituting an arc suppression chamber are incorporated in an enclosed vessel (not illustrated) serving as a main unit of the puffer type gas circuit breaker. After they have been assembled into a puffer type gas circuit breaker, the enclosed vessel is filled with arc suppression gas such as sulfur hexafluoride, whereby a puffer type gas circuit breaker is formed as a complete product.

The operation of this puffer type gas circuit breaker at the time of opening is performed when the puffer cylinder 4 is driven in the right-hand direction by the operation mechanism through the insulated operation rod 6. Then the state shown in FIG. 4 shifts to the state of opening as shown in FIG. 5.

In this case, the movable arc contact 3 in the state of conduction is opened from the fixed arc contact 1 so that arc A occurs between them. In this case, arc suppression gas in the puffer chamber 7 is compressed and is led into by insulated nozzle 2 to be blown on arc A so that suppression of arc A is promoted with the result that arc A is quickly extinguished and current is interrupted.

Insulated nozzle 2 is commonly made of heat proof resin such as ethylene tetrafluoride resin. When the insulated nozzle 2 is exposed to arc A, energy radiated from arc A breaks into insulated nozzle 2 itself, and is absorbed therein. Then a void or carbonization occurs to the material of insulated nozzle 2, with the result that the creepage insulation performance of insulated nozzle 2, hence interpolar insulation performance, is deteriorated.

To solve this problem, proposals have been made to mix powdered inorganic material into the heat proof resin constituting the insulated nozzle so that energy radiated from arc A is prevented from entering the insulated nozzle 2, whereby arc proof characteristics can be improved. Here mixing of inorganic material can also be called filling with an inorganic filler.

According to Japanese Patent Application Laid-Open No. 49(1974)-17657, Alumina ($Al_2O_3$) is recommended as an inorganic material to be mixed, and according to Japanese Patent Application Laid-Open No. 48(1973)-38216, calcium fluoride ($CaF_2$), magnesium fluoride ($MgF_2$), lead sulfide (SbS), barium sulfate ($BaSO_4$) and boron nitride (BN) as such.

Various other suggestions have been proposed regarding the form of mixture of these inorganic materials, in addition to mixing of the inorganic material at a certain density throughout the insulated nozzle. For example, Japanese Patent Application Laid-Open No. 5(1993)-94743 discloses that an inorganic material is mixed up to a certain distance from the inner diameter side in the direction at a right angle to the insulated nozzle axis.

Japanese Patent Application Laid-Open No. 5(1993)-74287 discloses that the type and density of the inorganic material to be mixed are changed stepwise with respect to the distance in the direction at a right angle to the axis. Japanese Patent Application Laid-Open No. 7(1995)-296689 discloses that multiple areas with different mixing densities of inorganic material are provided with respect to the distance in the axial direction of the insulated nozzle, and areas with densities varying continuously among the aforementioned areas are provided.

The aforementioned prior art fails to pay attention to the reduction in the amount of inorganic material, and raises the problem of an overall cost increase in a puffer type gas circuit breaker.

In general, heat proof resin containing such an inorganic material as BN is considerably more expensive than a single heat proof resin. Accordingly, insulated nozzle production cost will be increased by a large amount of mixture.

In the prior art insulated nozzle, however, inorganic material is mixed on all the portions on the side of a puffer cylinder ranging from the upstream to downstream sides with respect to the distance in the axial direction of the insulated nozzle. Production cost is increased by a great amount of inorganic material.

SUMMARY OF THE INVENTION

Thus, an object of the present invention is to provide a puffer type gas circuit breaker characterized by a sufficient cost reduction and excellent arc resistance ensured by mixing inorganic material in the insulated nozzle made of heat proof resin.

The above object can be attained by the present invention which provides a puffer type gas circuit breaker with an arc suppression gas feed insulated nozzle made of heat proof resin on the periphery of a movable arc contact characterized in that;

the area in the vicinity of the throat of this insulated nozzle is made of heat proof resin containing an inorganic material, while the portion except for the aforementioned area in the vicinity of the throat is made of heat proof resin without inorganic material;

wherein the aforementioned movable arc contact has a movable arc contact cover for arc suppression gas feed made of heat proof resin between this movable arc contact and insulated nozzle; and the downstream area of this movable arc contact cover is made of heat proof resin containing inorganic material, while the upstream area is made of heat proof resin without inorganic material.

Here the aforementioned portion of the insulated nozzle made of heat proof resin without inorganic material can constitute the downstream and upstream areas except for said area in the vicinity of the throat. Alternatively, the aforementioned portion of the insulated nozzle made of heat proof resin without inorganic material can constitute only the aforementioned upstream area of the throat.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 3:
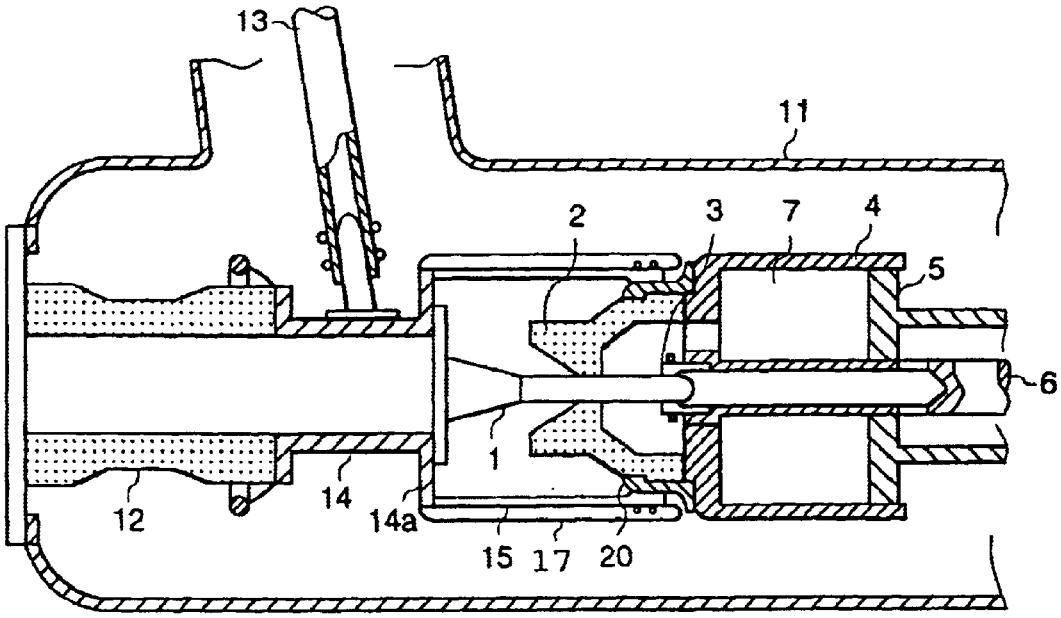
FIG. 3 is a section of the preferred embodiment of a puffer type gas circuit breaker according to the present invention.

An embodiment of a puffer type gas circuit breaker according to the present invention will be discussed hereinafter with reference to the drawings. FIG. 3 is an illustration showing a general construction of the puffer type gas circuit breaker according to the present invention.

As shown in FIG. 3, a metal container 11 interior of which is filled with arc extinguishing gas, is formed into substantially cylindrical shape. A circuit breaking portion arranged within the metal container 11 is supported with electrically insulating from the metal container by an insulative supporting member 12.

Both ends of the circuit breaking portion thus supported are led out of the metal container 11 by a bushing or a center conductor 13 of gas insulative bus conductor. On right end of the insulative supporting member 12 in FIG. 3, a connecting conductor 14 is connected. The center conductor 13 is electrically connected to the connecting conductor 14. On the other hand, on the connecting conductor 14, a fixed main contact 15 of the circuit breaking portion and the fixed arc contact 1 are secured. Also, a shield 17 surrounding the fixed main contact 15 of the circuit breaking portion and the fixed arc contact 1 is mounted on a flange 14*a* of the connecting conductor 14 by means of bolts or the like.

A compression device constructed with the puffer piston 5 and the puffer cylinder 4 takes the puffer cylinder 4 as movable component, for example. To the puffer cylinder 4, a movable main contact 20 contacting with the fixed main contact 15, the insulated nozzle having an orifice portion, in which the fixed arc contact 1 is engaged, and a movable arc contact 3 contacting with the fixed arc contact 1 within the insulated nozzle are coupled with the puffer cylinder 4. With respective contacts and the compression device, the circuit breaking portion is constructed.

Circuit breaking operation is performed by compressing gas within the puffer chamber 7 of the compression device by driving the center shaft of the puffer cylinder 4 by a not shown operating device via an insulated operation rod, and by opening between the main contacts 15 and 20 and subsequently opening between the arc contacts 1 and 3. Arc generated by opening between the arc contacts 1 and 3 is extinguished by blowing the arc extinguishing gas guided by the insulated nozzle 2 from the compressing device.

Figure 1:
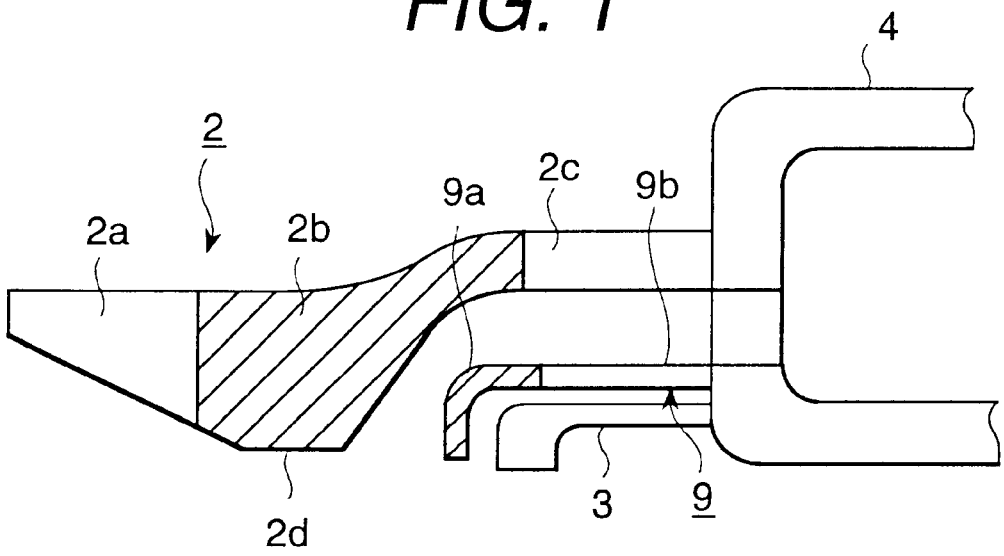
FIG. 1 is an enlarged view of the cross section representing the major portions of a puffer type gas circuit breaker as one embodiment according to the present invention.

FIG. 1 represents an embodiment of the present invention. Numeral 2*a* in this Figure denotes a downstream area of insulated nozzle 2, 2*b* an area in the vicinity of the throat, 2*c* an upstream area, 9 a downstream contact cover, 9*a* a downstream area of movable arc contact cover, and 9*b* an upstream area.

Figure 4:
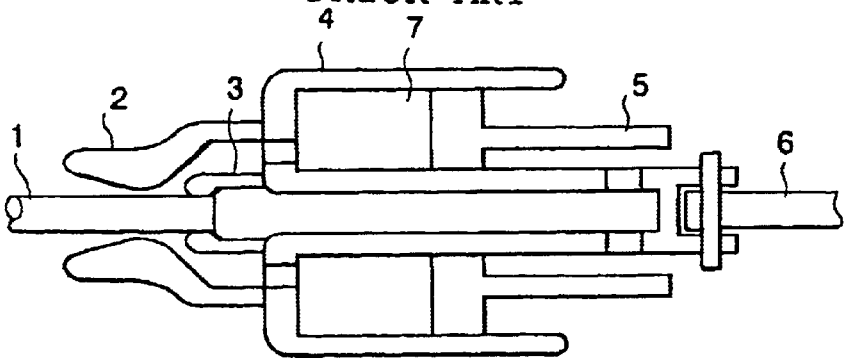
FIG. 4 PRIOR ART
FIG. 4 is across section of the major portions representing a closed state in an example of a prior art puffer type gas circuit breaker.
Figure 5:
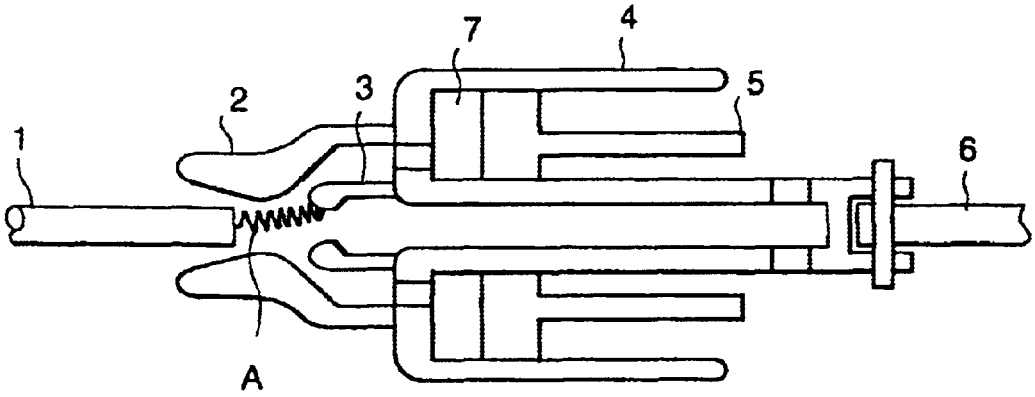
FIG. 5 PRIOR ART
FIG. 5 is a cross section of the major portions representing the process of opening in an example of a prior art puffer type gas circuit breaker.

In the embodiment of FIG. 1, other configuration including the insulated nozzle 2 is the same as that of the prior art puffer type gas circuit breaker described with reference to FIGS. 1 and 4. FIG. 1 shows only the movable side of the breaker in the puffer type gas circuit breaker, and furthermore, only the upper half of the movable side.

As described above, the insulated nozzle 2 in the embodiment shown in FIG. 1 consists of separate portions of the downstream area 2*a*, area in the vicinity of the throat 2*b*, upstream area of insulated nozzle 2*c*, and movable arc contact 3. In the first place, the downstream area 2*a* is made of only the ethylene tetrafluoride resin without inorganic material. The area in the vicinity of the throat 2*b* is made of ethylene tetrafluoride resin containing 1 to 20 volume percent of boron nitride as inorganic material, whereas the upstream area 2*c* is made of only the ethylene tetrafluoride resin, similarly to the downstream area 2*a*.

In the embodiment of FIG. 1, movable arc contact cover 9 is provided so as to surround the movable arc contact 3. This movable arc contact cover 9 is divided into downstream area 9*a* and upstream area 9*b*. The downstream area 9*a* is made of ethylene tetrafluoride resin containing 1 to 20 volume percent of boron nitride as inorganic material, whereas the upstream area 9*b* is made of only the ethylene tetrafluoride resin without inorganic material.

The following describes the operation of the present embodiment when current is interrupted:

When current is interrupted in this embodiment, arc occurs between the fixed arc contact 1 (not illustrated in FIG. 1) and movable arc contact 3, similarly to the case of the prior art described with reference to FIGS. 3 and 4, and irradiated energy is applied to the inner surface of the insulated nozzle 2 and both the inner and outer surfaces of the movable arc contact cover 9.

The portion exposed to the highest level of energy in this case is the inner surface 2*d* of the upstream area 2*c* where the inner diameter of the insulated nozzle 2 is smaller and distance from arc is shorter. In the present embodiment, the greater part of the incoming energy is reflected by the boron nitride contained in the area in the vicinity of the throat 2*b*, and insulated nozzle 2 is protected against possible damage due to incoming energy since the inner side of the insulated nozzle 2 is shielded.

A movable arc contact cover 9 is provided and boron nitride is contained in the area in the vicinity of the throat 9*b*, whereby the greater part of the incoming energy is reflected and the insulated nozzle 2 is shielded, with the result that insulated nozzle 2 is further protected against possible damage due to incoming energy.

In the embodiment of FIG. 1, the portion of the insulated nozzle 2 containing boron nitride can be restricted to the area in the vicinity of throat 2*b*. This reduces the amount of boron nitride used with respect to the entire insulated nozzle 2, and allows the insulated nozzle 2 to be manufactured at smaller production costs.

The present embodiment requires boron nitride to be contained in the downstream area 9*a* of movable arc contact cover 9. This movable arc contact cover 9 has a volume considerably smaller than insulated nozzle 2, and the portion containing boron nitride is restricted to downstream area 9*a*.

The amount of boron nitride contained with respect to the area in the vicinity of the throat 2*b* of insulated nozzle 2 decreases by the amount of incoming arc energy reduced by the presence of the aforementioned movable arc contact cover 9 with respect to insulated nozzle 2. This indicates a reduction in the amount of boron nitride used in terms of the entire circuit breaker.

Thus, the present embodiment sufficiently protects the insulated nozzle made of heat proof resin against possible damage while reducing the amount of inorganic material, with the result that a puffer type gas circuit breaker characterized by excellent arc resistance can be easily manufactured at a lower cost.

Another embodiment according to the present invention will be described with reference to FIG. 2.

Figure 2:
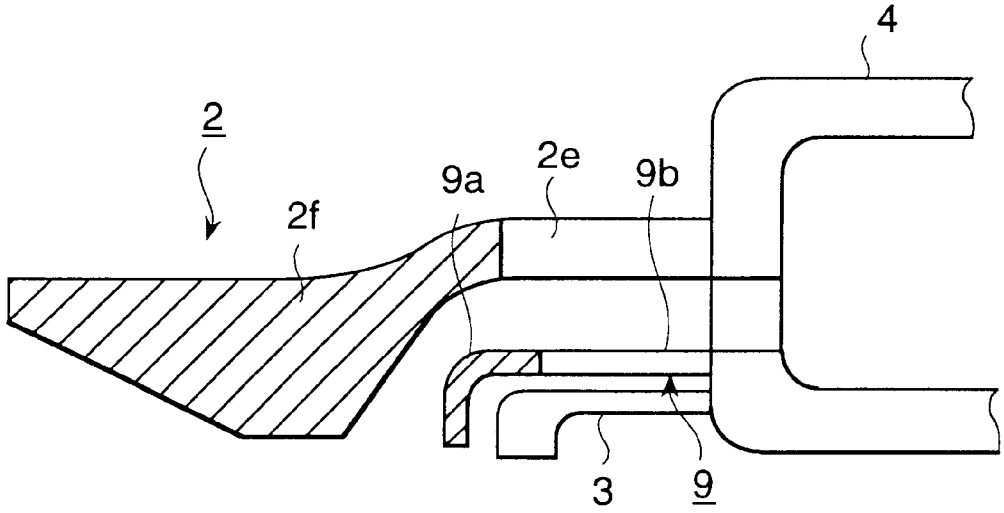
FIG. 2 is an enlarged view of the cross section representing the major portions of a puffer type gas circuit breaker as another embodiment according to the present invention.

In one embodiment according to the present invention shown in FIG. 2, the insulated nozzle 2 is divided into two areas. One is an upstream area 2*e* and the other is a downstream area 2*f*. Other configuration is the same as that of the embodiment shown in FIG. 1.

The downstream area 2*f* is made of ethylene tetrafluoride resin containing 1 to 20 volume percent of boron nitride, while the upstream area 2*e* is made of the ethylene tetrafluoride resin alone without containing inorganic material.

Accordingly, FIG. 2 exemplifies an variation of the embodiment of FIG. 1. The simpler configuration of the insulated nozzle 2 reduces the cost correspondingly on the one hand. On the other hand, the area containing boron nitride in the insulated nozzle 2 is increased; this fails to reduce the cost correspondingly.

Depending on the differences in electric and thermo-hydrodynamic configuration, however, dimensions in the downstream area 2*f* of insulated nozzle 2 can be reduced. This means a reduction in the amount of boron nitride to be used.

Further, since the amount of incoming arc energy to the insulated nozzle 2 is reduced by movable arc contact cover 9, the amount of boron nitride contained in downstream area 2*f* is reduced. This signifies a reduction in the total amount of boron nitride, hence a cost reduction.

Embodiments according to the present invention have been described above; however, it should not be understood that the present invention is limited only to the above-mentioned embodiments. Further, other materials than boron nitride can be used as an inorganic material. The same effect can be gained by using the above-mentioned almina, calcium fluoride, magnesium fluoride, lead sulfide or barium sulfide.

The above statement is applicable to the heat proof resin; namely, the same effect can be obtained by the use of fluorine resin other than the aforementioned ethylene tetrafluoride resin and silicon based resin.

According to the present invention, the insulated nozzle is divided into multiple areas in the axial direction. The mixture of inorganic material is present in some areas but not in others, and the mixing ratio in each area is changed. Furthermore, a movable arc contact cover is provided, wherein the mixture of inorganic material is present in some areas but not in others, and the mixing ratio in each area is changed. This minimizes possible damage of the insulated nozzle caused by due to arc irradiation energy, reduces deterioration of creepage insulation performance in the vicinity of the throat, and cuts down the amount of the inorganic material used as a whole.

Figure 6:
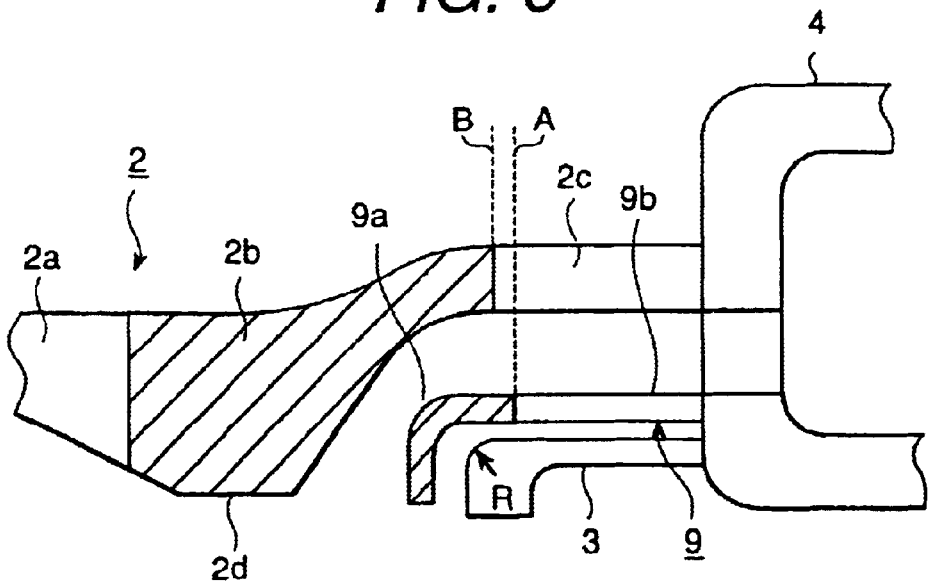
FIG. 6 is a further enlarged section of a puffer type gas circuit breaker showing detailed construction of portion containing inorganic material.

Next, discussion will be given for detailed embodiment relating to inorganic material in the present invention with reference to FIG. 6.

The movable arc contact 3 is bent into L-shaped configuration with a rounded corner having a curvature radius R at downstream side in opposition to the downstream contact cover 9. The downstream area 9*a* of the downstream contact cover 9 containing inorganic material is extended to a boundary A corresponding to the upstream side end of the rounded corner of the movable arc contact 3. With such inorganic material containing downstream area 9*a*, arc generated upon separation of the fixed arc contactor 1 and the movable arc contactor 3 is not generated on upstream side of the movable arc contact 3 beyond the rounded corner of the curvature radius R of the movable arc contact 3. Therefore, only area where arc is generated from the movable arc contact is required to be covered by the inorganic material containing downstream area 9*a* of the downstream contact cover 9. As a result, the inorganic material containing downstream area 9*a* of the downstream contact cover 9 can be necessary minimum size.

On the other hand, the area in the vicinity of the throat containing inorganic material is extended up to a boundary B located at flat area continuous to the curved portion connecting a thick portion of the nozzle 2*d* and the upstream area 2*c*. As can be seen from FIG. 6, the boundary B is offset from the boundary A toward downstream side. Since arc to be generated upon separation of the fixed arc contact 1 and the movable arc contact 3 can be blocked by the downstream area 9*a* of the downstream contact cover 9, the inorganic material containing area 2*b* in the vicinity of the throat can be terminated at the position downwardly offset from the boundary A and at flat area continuous to the curved portion connecting a thick portion of the nozzle 2*d* and the upstream area 2*c*. Thus, measure for arc generation can be taken with necessary minimum size of the area 2*b* in the vicinity of the throat containing inorganic material.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

It should be noted that the foregoing embodiment is to achieve effect for the arc by means of a member containing necessary minimum inorganic material. However, the present invention should not be limited to the embodiment at forth above. Similar effect can be achieved even when member containing inorganic material can be extended in the direction toward the upstream area 9*b* of the movable arc contact and the upstream area 2*c* of the insulated nozzle 2, for example.

Thus, the present invention easily provides a puffer type gas circuit breaker characterized by sufficient insulation performance at a low cost.

What is claimed is:

1. A puffer type gas circuit breaker with an arc suppression gas feed insulated nozzle made of heat proof resin provided on the periphery of a movable arc contact characterized in that;

said insulated nozzle comprises a downstream area, an area in the vicinity of a throat and an upstream area, and wherein said area in the vicinity of the throat of said insulated nozzle contains inorganic material, while the said downstream area and said upstream area do not contain said inorganic material;

a movable arc contact cover is installed between said nozzle and said movable arc contact so as to surround said moveable arc contact; and said movable arc contact cover has a downstream area and an upstream area, and said downstream area is made of heat proof resin containing inorganic material, while said upstream area is made of heat proof resin not containing said inorganic material.

2. A The puffer type gas circuit breaker according to claim 1, wherein said heat proof resin comprises ethylene tetrafluoride.

3. A The puffer type gas circuit breaker according to claim 1, wherein said area of said insulated nozzle of heat proof resin containing inorganic material is formed with a portion of a bent shape, and said area containing inorganic material extends from a portion located at upstream side of said bent portion.

4. A puffer type gas circuit breaker with an arc suppression gas feed insulated nozzle made of heat proof resin provided on the periphery of a movable arc contact characterized in that; said insulated nozzle comprises a downstream area, an area in the vicinity of a throat and an upstream area, and wherein said area in the vicinity of the throat of said insulated nozzle contains an inorganic material, while said upstream area does not contain said inorganic material;

a movable arc contact cover is installed between said nozzle and said movable arc contact so as to surround said movable arc contact; and said movable arc contact cover has a downstream area and an upstream area, and said downstream area is made of heat proof resin containing inorganic material, while said upstream area is made of heat proof resin not containing said inorganic material.

5. The puffer type gas circuit breaker according to claim 1, wherein said area in the vicinity of the throat is formed on downstream side of an area of said movable arc contact.

* * * * *